US006981781B2

(12) United States Patent
Tseng

(10) Patent No.: US 6,981,781 B2
(45) Date of Patent: Jan. 3, 2006

(54) DECORATIVE LIGHT SUPPORTING ASSEMBLY

(76) Inventor: Wei-Jen Tseng, 5F, No. 10, Lane 23, Tungshan St., Hsinchu (TW)

( * ) Notice: Subject to any disclaimer, the term of this patent is extended or adjusted under 35 U.S.C. 154(b) by 0 days.

(21) Appl. No.: 10/773,491

(22) Filed: Feb. 6, 2004

(65) Prior Publication Data

US 2005/0174799 A1 Aug. 11, 2005

(51) Int. Cl.
*A47G 33/10* (2006.01)
*F21S 13/14* (2006.01)

(52) U.S. Cl. ..... 362/252; 362/457; 362/808

(58) Field of Classification Search ..... 362/249, 362/252, 806, 122–123, 236–238, 377–378, 362/396, 436, 808, 457, 565
See application file for complete search history.

(56) References Cited

U.S. PATENT DOCUMENTS 6,478,455 B2 * 11/2002 Ahroni ..... 362/352
6,531,829 B1 * 3/2003 Tsai ..... 315/185 S

* cited by examiner

*Primary Examiner*—Sandra O'Shea
*Assistant Examiner*—Guiyoung Lee
(74) *Attorney, Agent, or Firm*—Jackson Walker, LLP

(57) ABSTRACT

A decorative light supporting assembly includes a bonding element having multiple V-like bodies interlinked with one another, multiple support branches each having a frame with multiple protrusions integrally formed with the frame and an arrow-shaped connector integrally formed on a bottom of the frame and being inclined relative to the frame such that insertion of the arrow-shaped connectors from the support branches into corresponding V-like bodies is able to secure engagement between the bonding element and the support branches.

14 Claims, 13 Drawing Sheets

DECORATIVE LIGHT SUPPORTING ASSEMBLY

BACKGROUND OF THE INVENTION

1. Field of the Invention

The present invention relates to a supporting assembly, and more particularly to a decorative light supporting assembly with which light bulbs may be supported and the assembly may be expanded as required.

2. Description of Related Art

A conventional decorative light support generally has a firmed structure and thus the user is able to fix the decorative light support on a surface. However, this decorative light support shows the decorative effect only in two-dimensional coordinate. A vivid and three dimensional decorative effect is something which needs to be introduced.

To overcome the shortcomings, the present invention tends to provide an improved decorative light supporting system to mitigate the aforementioned problems.

SUMMARY OF THE INVENTION

The primary objective of the present invention is to provide an improved decorative light supporting assembly having a bonding element and multiple support branches detachably connected to the bonding element such that after the support branches are connected to and displayed on the bonding element, the extension of the support branches vividly show a three dimensional pattern, which increases the ornamental effect.

Another objective of the present invention is that a securing element is provided to the decorative light supporting system to secure the bonding element after the bonding element is rolled to form a circular body. Thus, the support branches displayed on the bonding element extend in different directions relative to the bonding element.

Other objects, advantages and novel features of the invention will become more apparent from the following detailed description when taken in conjunction with the accompanying drawings.

DETAILED DESCRIPTION OF THE PREFERRED EMBODIMENT

Figure 1:
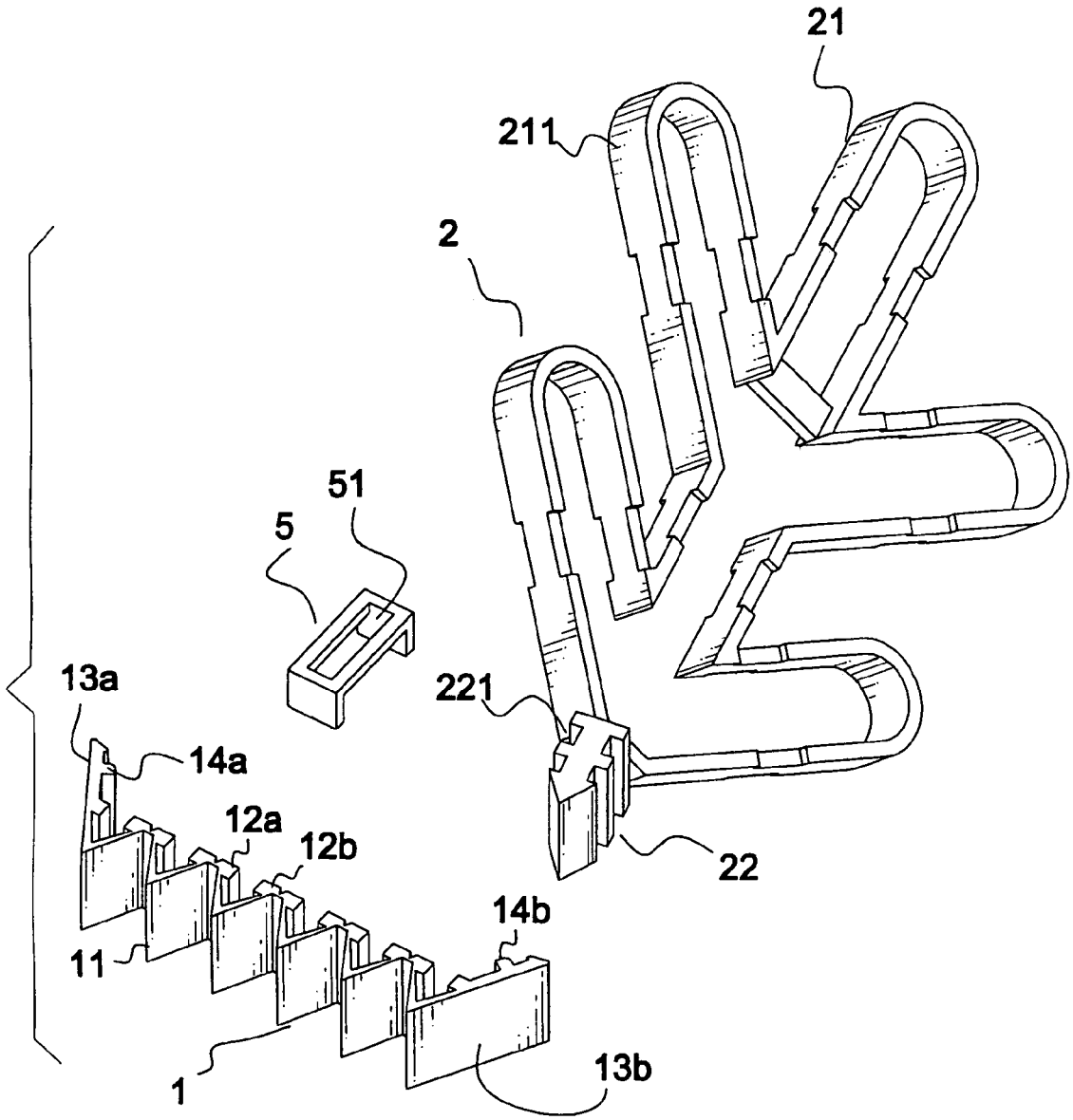
FIG. 1 is an exploded perspective, view of the light supporting assembly of the present invention.

With reference to FIG. 1, the decorative light supporting assembly in accordance with the present invention includes a bonding element (1), a support branch (2) and a securing element (5) with an opening (51) defined therethrough.

The bonding element (1) is made of a resilient material and has multiple V-like bodies (11) integrally formed with one another on the bonding element (1). Every body (11) has two guiding tracks (12*a*, 12*b*) formed on two distal ends of the body (11). A first wing (13*a*) is formed on the right-most body (11) and has a first rib (14*a*) formed on an inner face of the first wing (13*a*). A second wing (13*b*) is formed on the left-most body (11) and has a second rib (14*b*) formed on an inner face of the second wing (13*b*).

The support branch (2) includes a frame (21) with multiple fingers (211) integrally formed in the periphery of the frame (21) and a connector (22) shaped like an arrow and integrally formed on a tip of the frame (21) and having tracks (221) defined in opposite side faces of the connector (22) to correspond to the bodies (11) of the bonding element (1).

Figure 2:
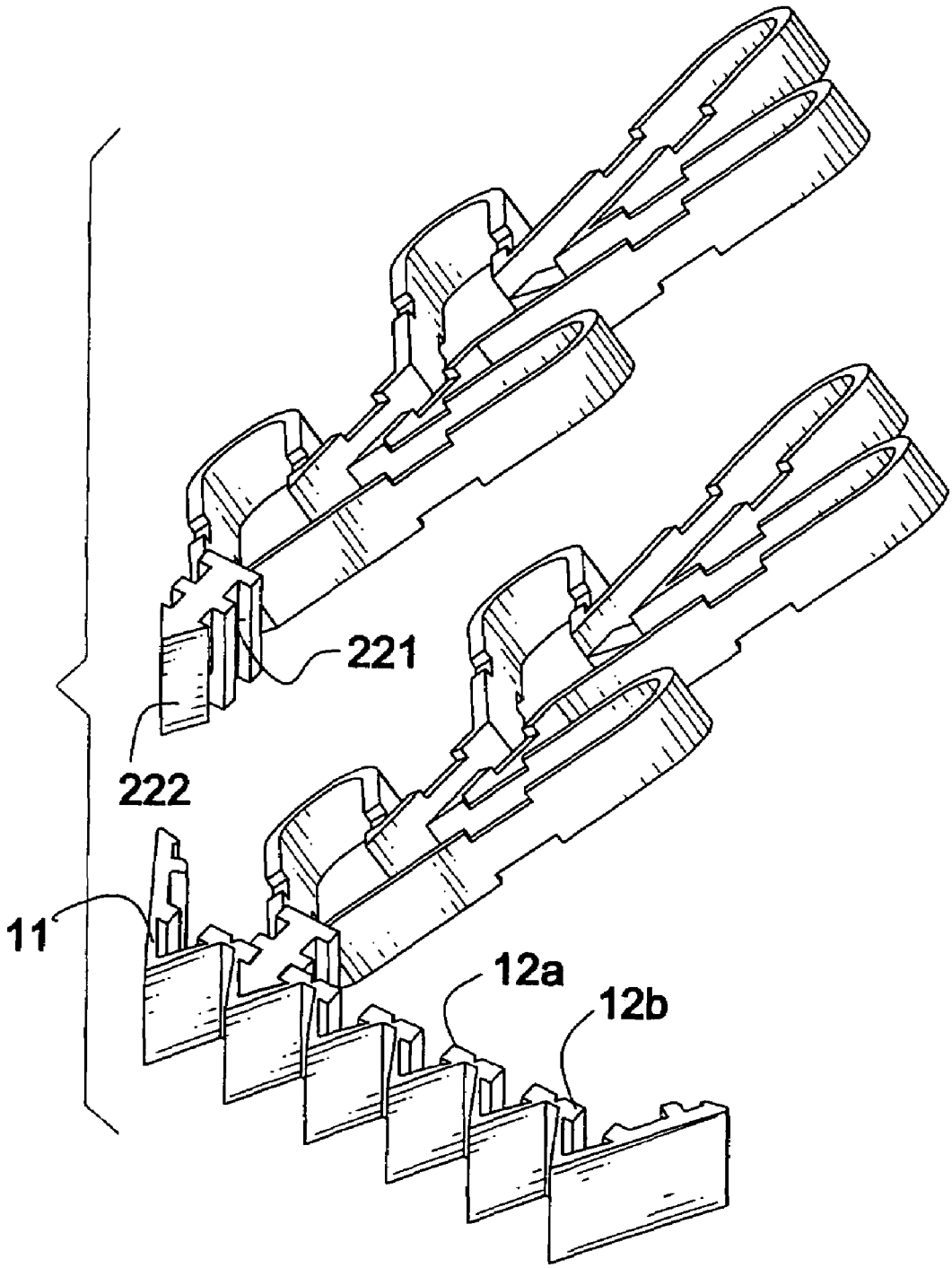
FIG. 2 is a schematic perspective view showing the connection between the bonding element and the support branches.
Figure 3:
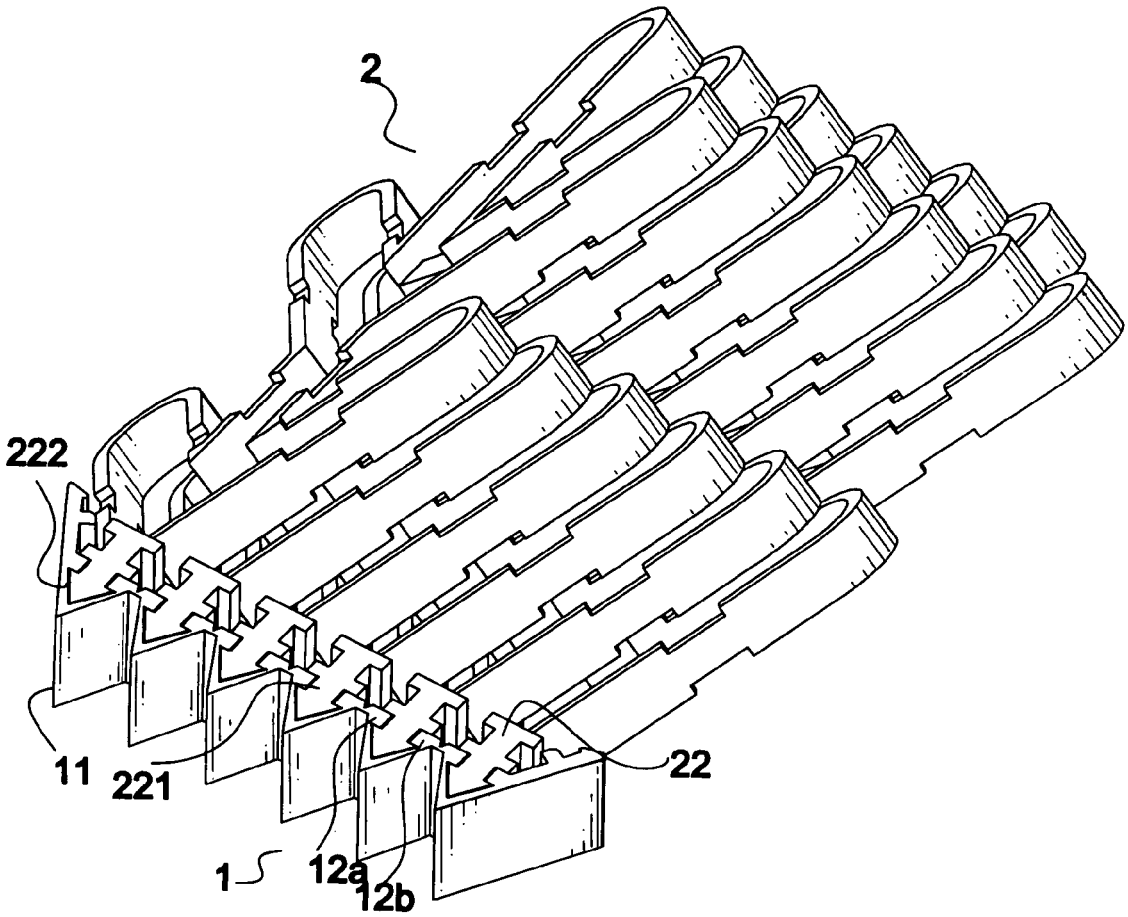
FIG. 3 is a perspective view showing that the bonding element is provided with multiple support branches.

With reference to FIGS. 2 and 3, it is noted that each connector (22) has a dimension slightly smaller than a dimension of each body (11) such that each and every one of the support branches (2) is able to engage with the bonding element (11) by inserting the connectors (22) into a corresponding one of the bodies (11) and sliding the guiding tracks (12*a*, 12*b*) along the tracks (221). After the connectors (22) are received in the bodies (11), the support branches (2) are securely connected to the bonding element (1). Further, it is noted that the connector (22) is inclined relative to the frame (21) such that when the support branches (2) are connected to the bonding element (1), the frames (21) are close to one another.

Figure 4:
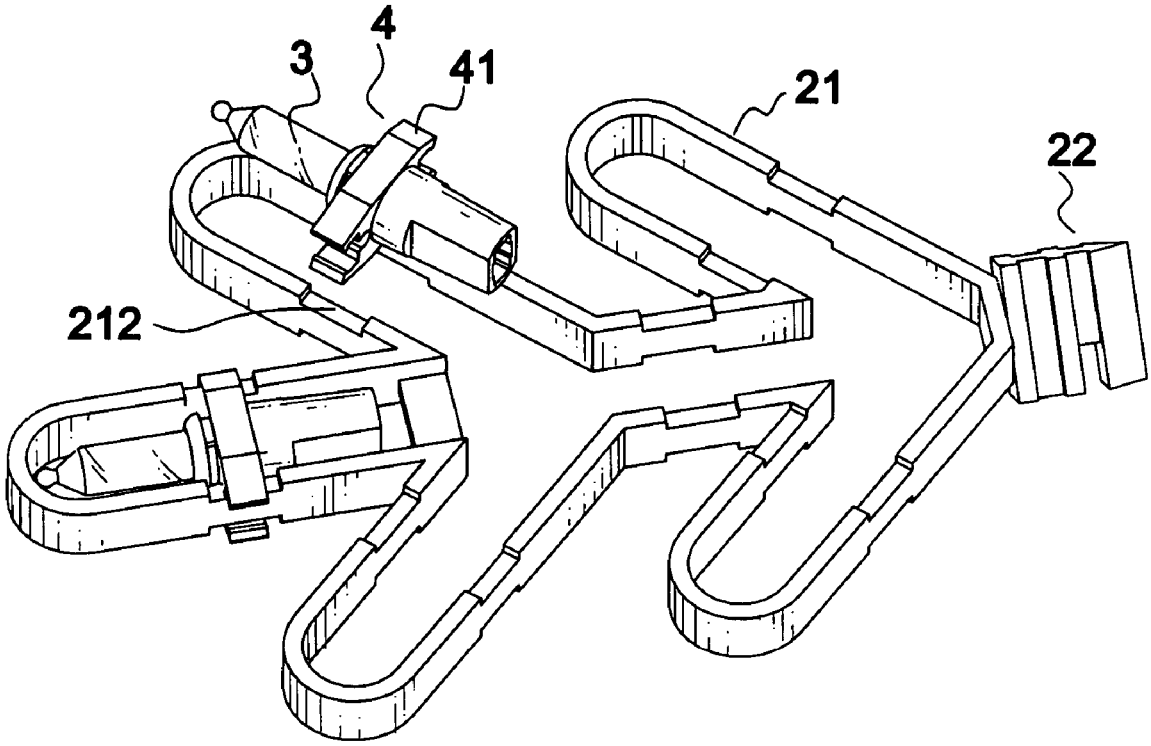
FIG. 4 is a perspective view showing a different embodiment of the support branch.

With reference to FIG. 4, it is noted that two cutouts (212) are respectively defined in opposite side faces of each protrusion (211) such that a bulb (3) with a clamp (4) and arms (41) are able to securely connect to the protrusion (211) by engagement between the arms (41) to bottom faces defining the cutouts (212).

Figure 5:
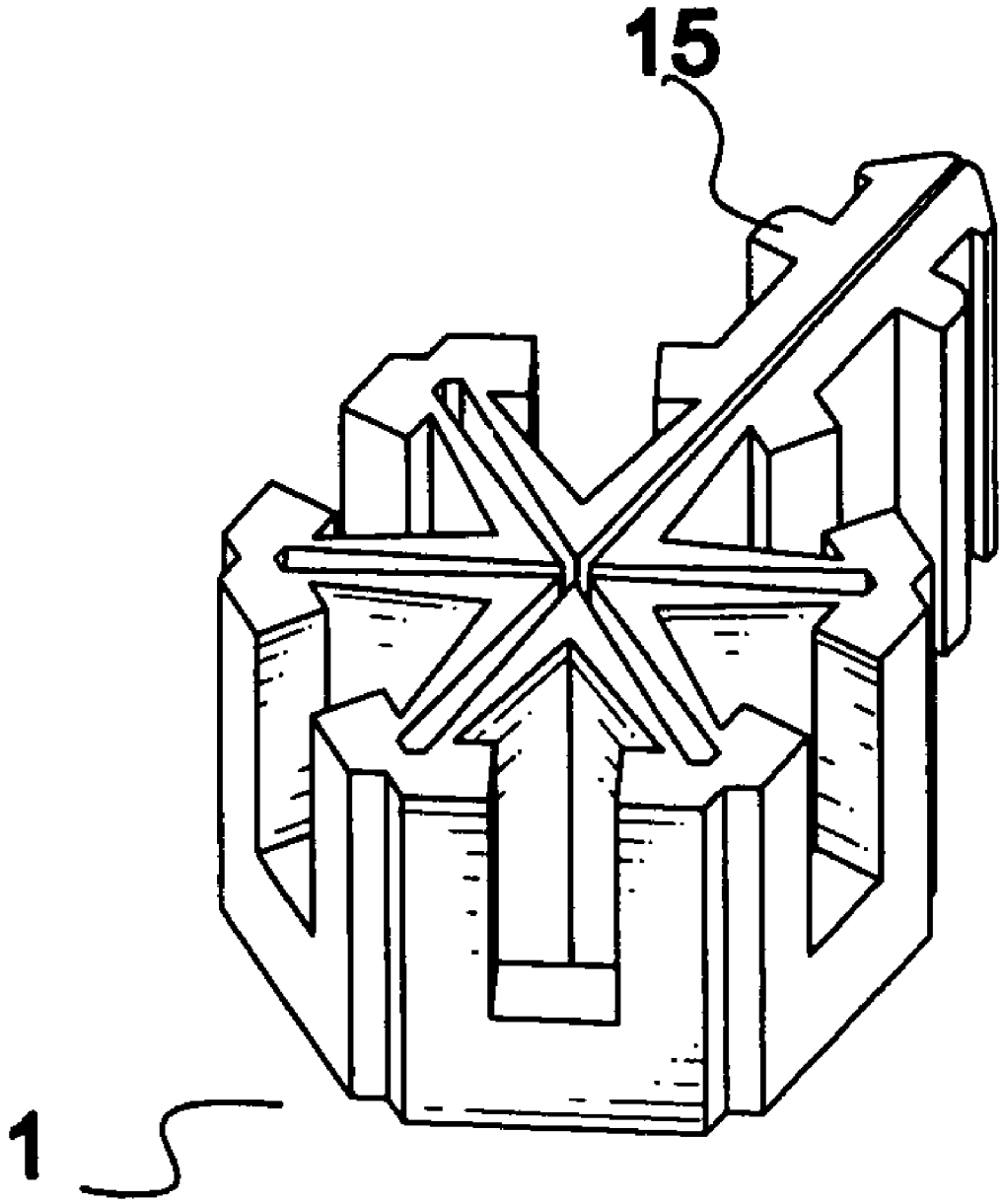
FIG. 5 is a perspective view showing the deformation of the bonding element.
Figure 6:
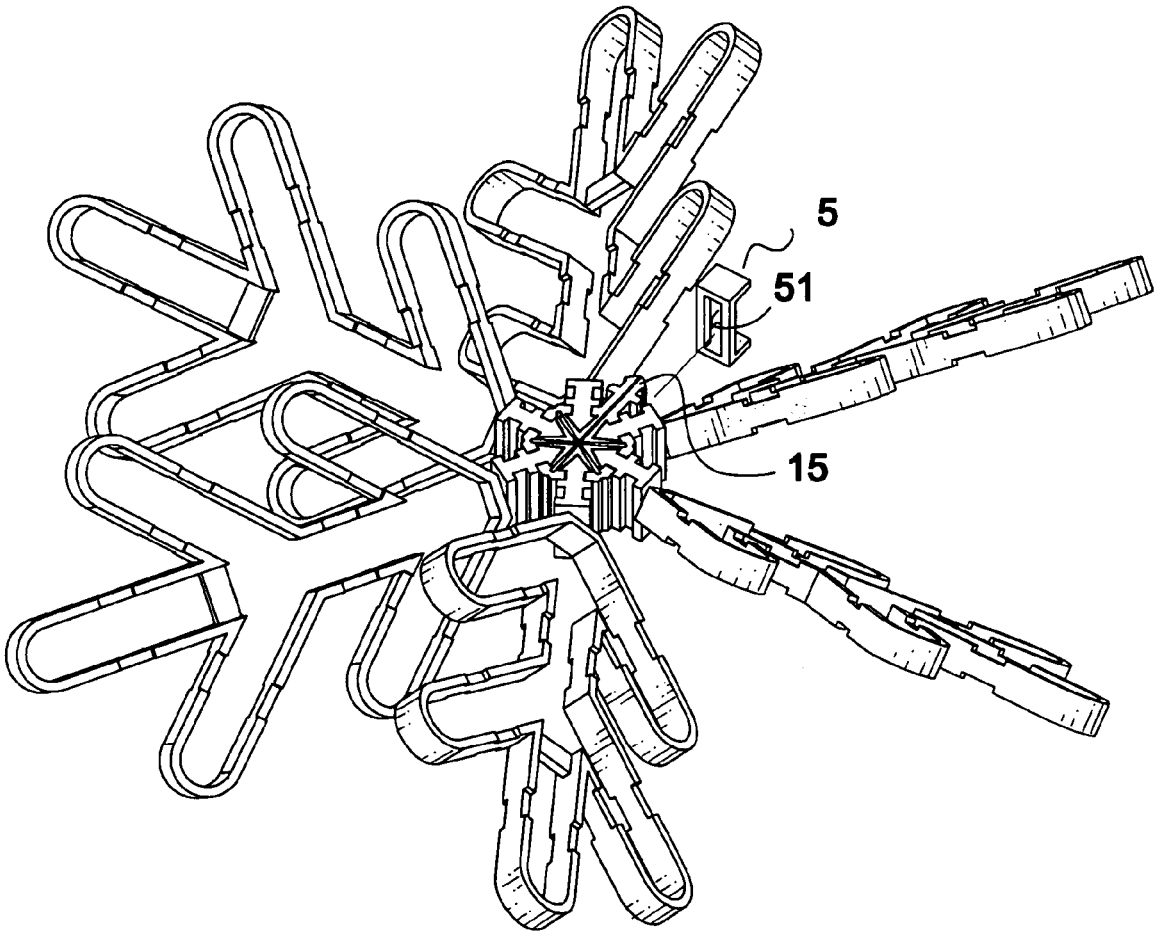
FIG. 6 is a schematic perspective view showing that a securing element is used to secure the deformation of the bonding element so as to allow the support branches to be extended in different directions.
Figure 7:
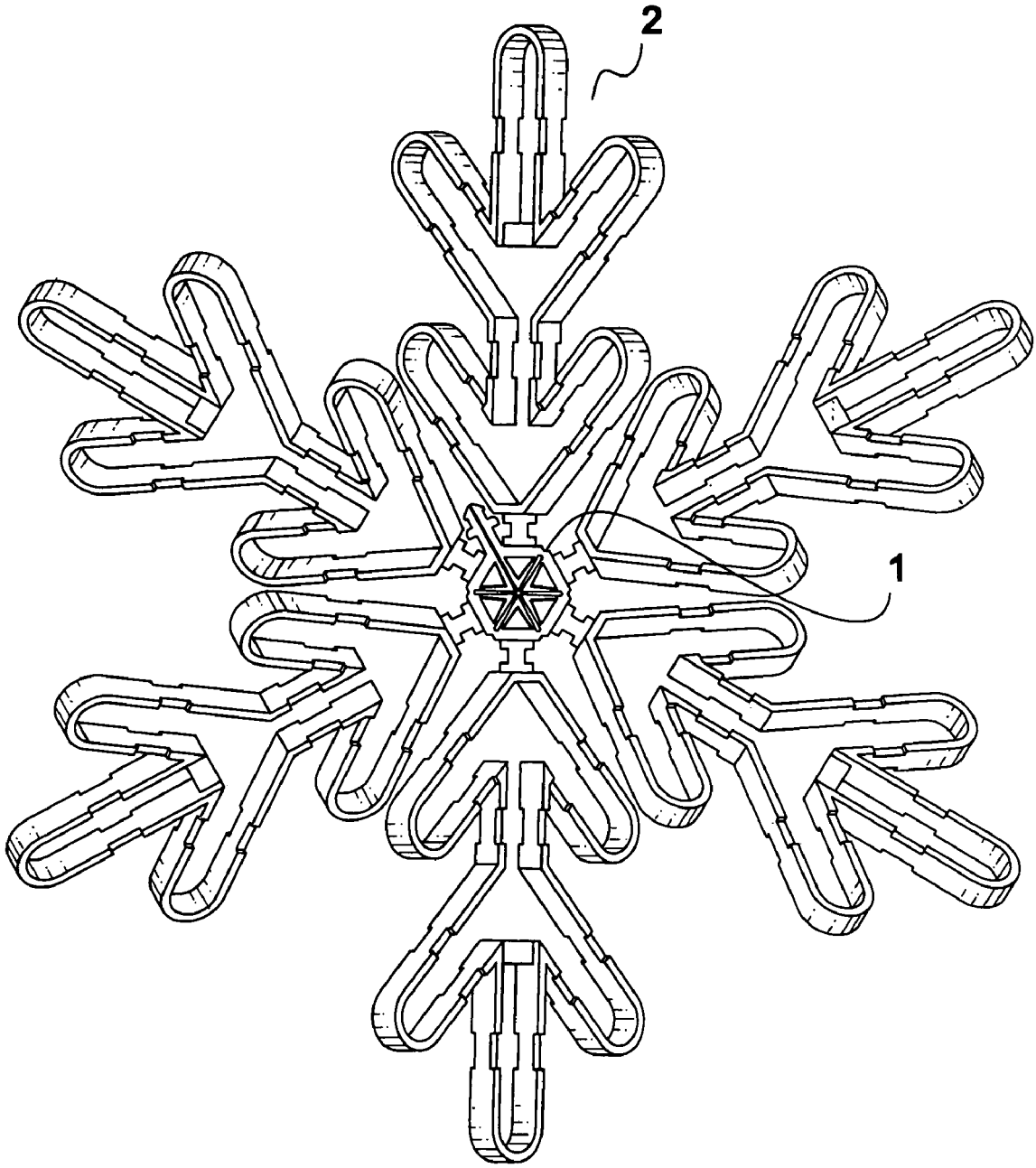
FIG. 7 is a perspective view showing that after the deformation of the securing element is secured, the support branches are extended to present a three dimensional ornamental effect.

With reference to FIGS. 5 and 6 and still using FIG. 1 for reference, it is noted that when the first wing (13*a*) and the second wing (13*b*) are engaged with one another to expose the first rib (14*a*) and the second rib (14*b*), the combination of the first rib (14*a*) and the second rib (14*b*) forms a stop (15). When the securing element (5) is applied to cope with the deformed bonding element (1), the first and second wings (13*a*,13*b*) as well as the stop (15) are extended through the opening (51) and thus abutment of the stop (15) to a side face defining the opening (51) secures the deformation of the bonding element (1). Therefore, when the bonding element (1) is full of support branches (2) by the manner as described earlier, application of the securing element (5) is able to present a snow flake pattern, which is completely different from what is, disclosed in any of the existing art.

Figure 8:
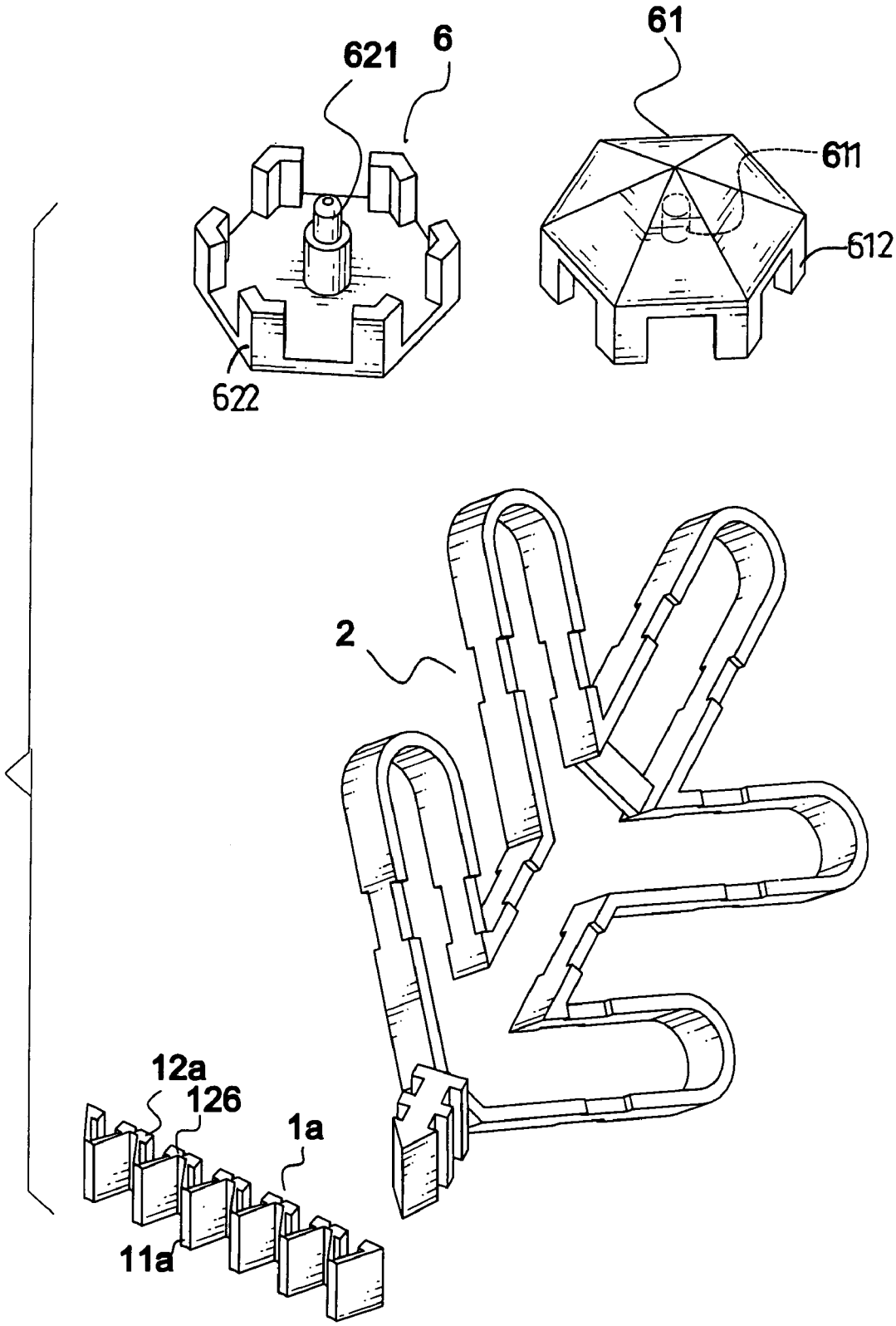
FIG. 8 is an exploded perspective view showing a different securing element is applied to an embodiment of the bonding element.
Figure 9:
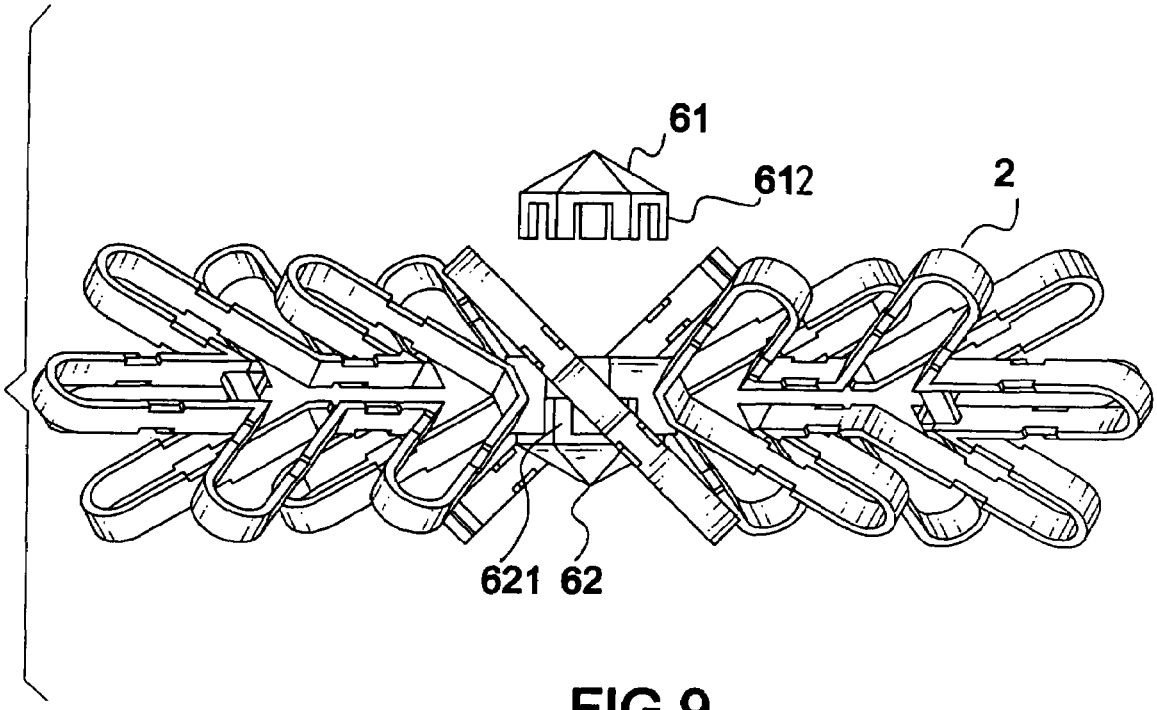
FIG. 9 is a schematic perspective view showing the application of the securing element to the deformed bonding element.

With reference to FIGS. 8 and 9, it is noted that another embodiment of the securing element (6) shows a top casing (61) and a bottom casing (62). The top casing (61) has multiple legs (611) extending from peripheral edges of the top casing (61) and a connecting hole (612) centrally defined in a bottom face of the top casing (61). The bottom casing (62) has a connecting rod (621) centrally extending from a bottom face of the bottom casing (62) and multiple extensions (622) extending from peripheral edges of the bottom casing (62) to correspond to the legs (611). When the securing element (6) in this embodiment is employed to the assembly of the bonding element (1) and the support branches (2), the legs (611) and the extensions (622) are respectively inserted into the bodies (11) of the bonding element (1) from opposite sides of the bodies (11). The extension of the connecting rod (621) into the connecting hole (611) is then able to secure engagement between the top casing (61) and the bottom casing (62). Thus the deformation of the bonding element (1) is secured and the snow-flake pattern is presented.

Figure 10:
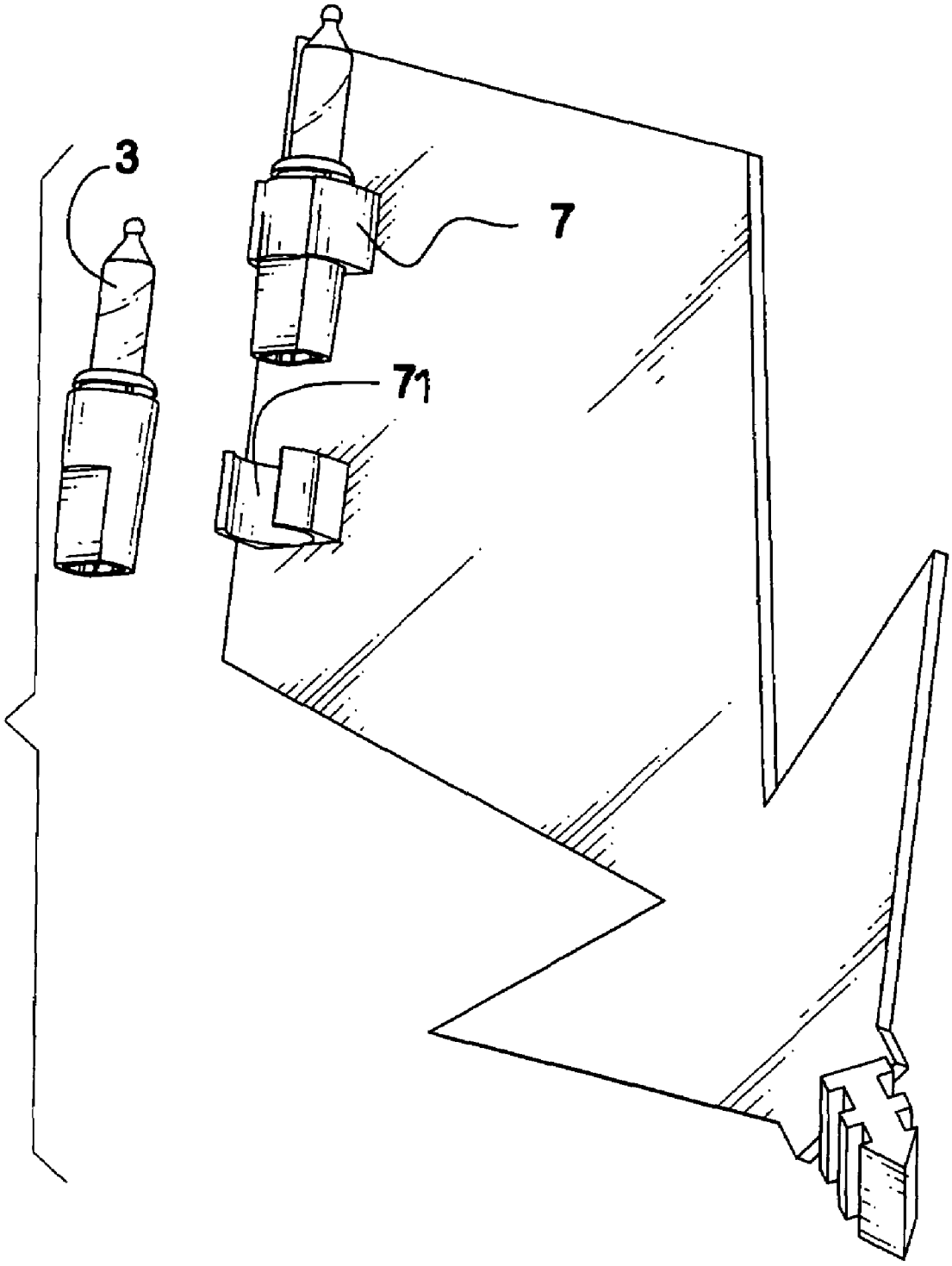
FIG. 10 is an exploded perspective view showing an embodiment of the support branch.

With reference to FIG. 10, it is noted that the clamp (7) is securely engaged with a side face of the body (2) and has a concave area (71) defined in the clamp (7) to receive therein the bulb (3).

Figure 11:
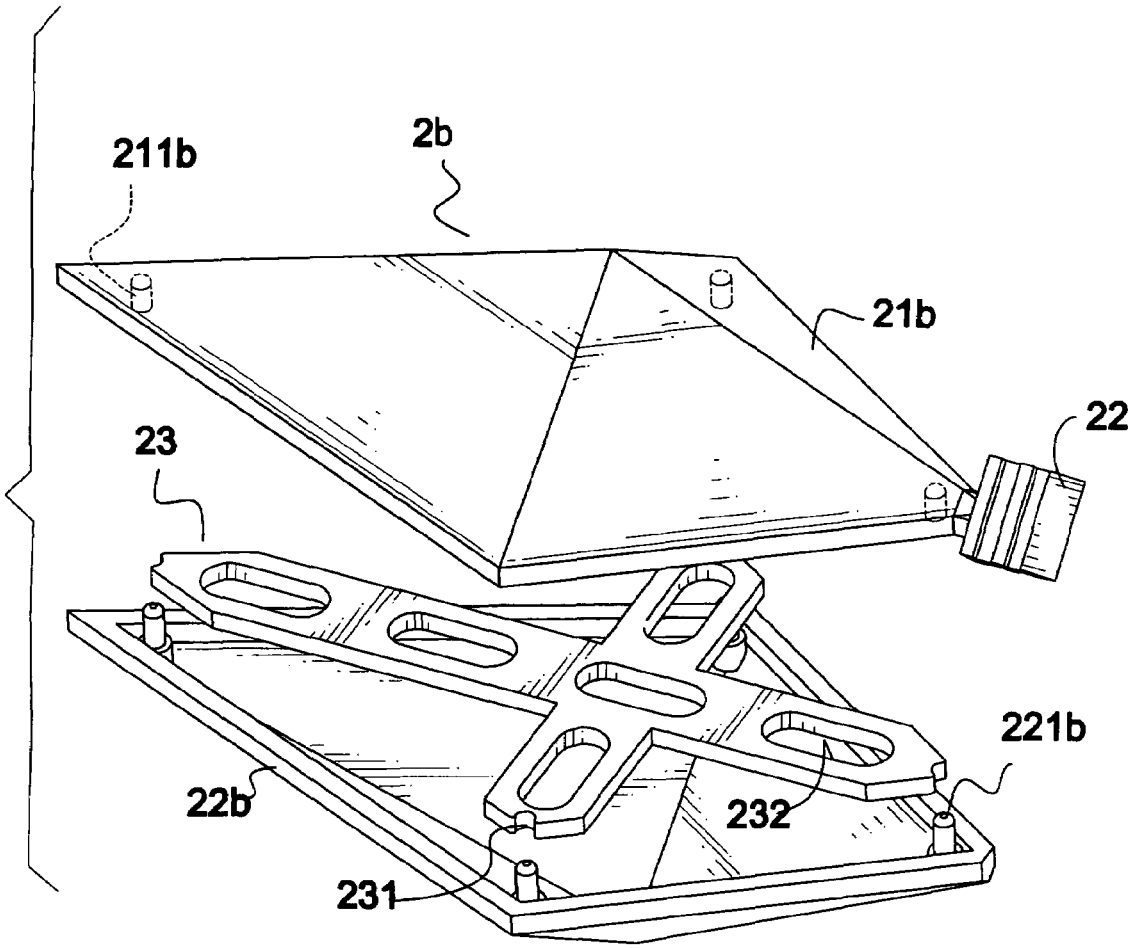
FIG. 11 is an exploded perspective view of an embodiment of the support branch.

With reference to FIG. 11, it is noted that the support branch (2*b*) is pyramidal and composed of a top portion (21*b*) and a bottom portion (22*b*). The top portion (21*b*) has multiple apertures (211*b*) defined in corners of a bottom face of the top portion (21*b*). The configuration of the bottom portion (22*b*) corresponds to that of the top portion (21*b*) and has multiple rods (221*b*) corresponding to the apertures (211*b*) of the top portion (21*b*). A cross (23) is sandwiched between the top portion (21*b*) and the bottom portion (22*b*) and has indentation (231) defined in distal ends of the cross (23) to correspond to the rods (221*b*) and holes (232) defined in the cross (23). Therefore, insertion of the rods (221*b*) into the corresponding apertures (211*b*) is able to secure the engagement between the top portion (21*b*) and the bottom portion (22*b*).

Figure 12:
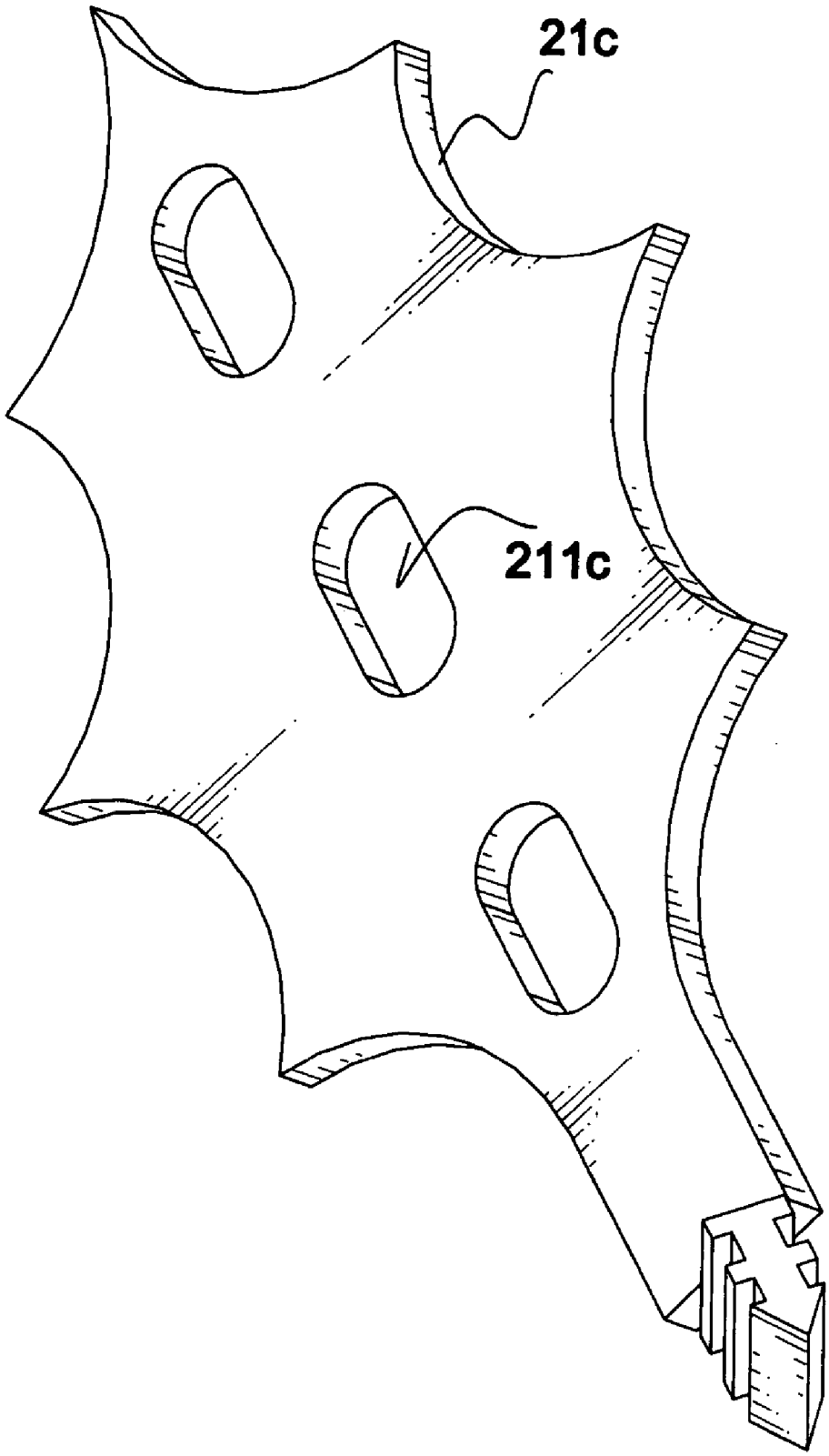
FIG. 12 is a perspective view of an embodiment of the body of the support branch.

With reference to FIG. 12 it is noted that the body (21*c*) has multiple through holes (211*c*) defined through the body (21*c*).

Figure 13:
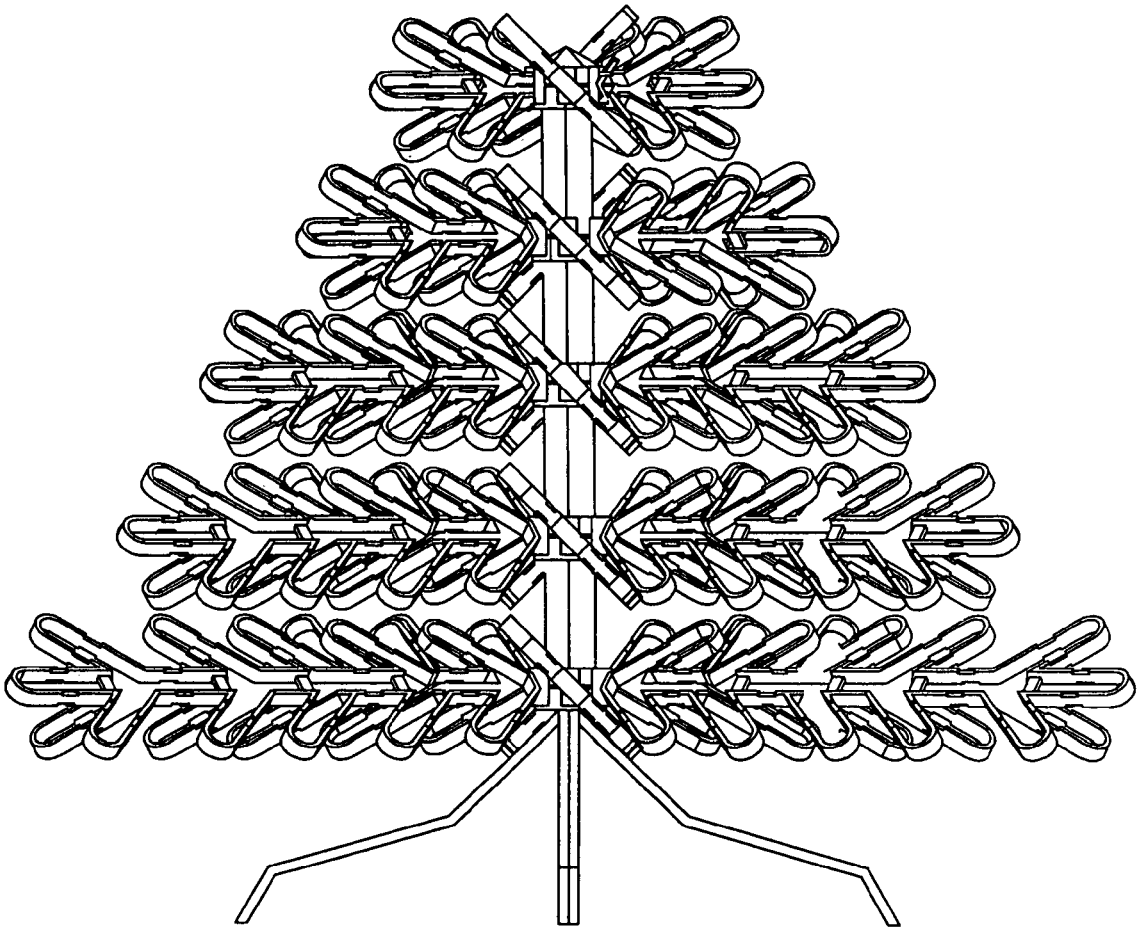
FIG. 13 is a perspective view showing the application of the decorative light supporting assembly of the present invention.

With reference to FIG. 13, it is noted that no matter what kind of shapes the body may become, after the support branches are connected to the bonding element and the bonding element is deformed, the extension of the support branches relative to the bonding element presents a pattern never seen in any of the products.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative light supporting assembly comprising:

a bonding element having multiple V-like bodies interlinked with one another, a securing element composed of a top casing provided with a centrally defined connecting hole in a bottom face of the top casing and multiple legs extending from peripheral faces of the top casing and a bottom casing provided with a centrally formed connecting rod corresponding to the connecting hole and multiple extensions extending from peripheral face of the bottom casing, wherein both legs and the extensions are extended to correspond to and receive in the V-like bodies of the bonding element; and multiple support branches each having a frame with multiple fingers integrally formed in a periphery of the frame and an arrow-shaped connector integrally formed on a tip of each frame and being inclined relative to the frame such that insertion of the arrow-shaped connector from each support branch into the corresponding V-shaped body is able to secure engagement between the bonding element and the support branches.

2. The decorative light supporting assembly as claimed in claim 1, wherein each V-like body has two guiding tracks formed on distal ends of the V-like body to correspond to tracks defined in opposite side faces of the arrow-shaped connector so that when the arrow-shaped connector is received in the corresponding V-shaped body, the guiding tracks slide in the tracks.

3. The decorative light supporting assembly as claimed in claim 2 further comprising a securing element composed of a top casing provided with a centrally defined connecting hole in a bottom face of the top casing and multiple legs extending from peripheral faces of the top casing and a bottom casing provided with a centrally formed connecting rod corresponding to the connecting hole and multiple extensions extending from peripheral face of the bottom casing, wherein both the legs and the extensions are extended to correspond to and receive in the V-like bodies of the bonding element.

4. The decorative light supporting assembly as claimed in claim 3, wherein each protrusion has a pair of cutouts defined in opposite side faces of the protrusion so that a clamp with a bulb securely attached thereto and arms extending in different directions is able to engage with bottom faces defining the cutouts to securely attach the bulb on the protrusion.

5. The decorative light supporting assembly as claimed in claim 2, wherein the bonding element has a first wing formed with the right most triangle and a second wing formed with the left most wing, the first wing has a first rib formed on an inner face of the first wing and the second wing has a second ring formed on an inner face of the second wing.

6. The decorative light supporting assembly as claimed in claim 5, wherein each protrusion has a pair of cutouts defined in opposite side faces of the protrusion so that a clamp with a bulb securely attached thereto and arms extending in different directions is able to engage with bottom faces defining the cutouts to securely attach the bulb on the protrusion.

7. The decorative light supporting assembly as claimed in claim 2, wherein each protrusion has a pair of cutouts defined in opposite side faces of the protrusion so that a clamp with a bulb securely attached thereto and arms extending in different directions is able to engage with bottom faces defining the cutouts to securely attach the bulb on the protrusion.

8. The decorative light supporting assembly as claimed in claim 1, wherein the bonding element has a first wing formed with the right most triangle and a second wing formed with the left most wing, the first wing has a first rib formed on an inner face of the first wing and the second wing has a second ring formed on an inner face of the second wing.

9. The decorative light supporting assembly as claimed in claim 8, wherein each protrusion has a pair of cutouts defined in opposite side faces of the protrusion so that a clamp with a bulb securely attached thereto and arms extending in different directions is able to engage with bottom faces defining the cutouts to securely attach the bulb on the protrusion.

10. The decorative light supporting assembly as claimed in claim 1, wherein each protrusion has a pair of cutouts defined in opposite side faces of the protrusion so that a clamp with a bulb securely attached thereto and arms extending in different directions is able to engage with bottom faces defining the cutouts to securely attach the bulb on the protrusion.

11. A decorative light supporting assembly comprising:

a bonding element having multiple V-like bodies interlinked with one another;

a securing element having an opening defined through the securing element such that when the bonding element is deformed to combine the first rib and the second rib to form a stop, extension of the stop into the opening of the securing element is able to secure the deformation of the bonding element; and multiple support branches each having a frame with multiple fingers integrally formed in a periphery of the frame and an arrow-shaped connector integrally formed on a tip of each frame and being inclined relative to the frame such that insertion of the arrow-shaped connector from each support branch into the corresponding V-shaped body is able to secure engagement between the bonding element and the support branches.

12. The decorative light supporting assembly as claimed in claim 11, wherein each protrusion has a pair of cutouts defined in opposite side faces of the protrusion so that a clamp with a bulb securely attached thereto and arms extending in different directions is able to engage with bottom faces defining the cutouts to securely attach the bulb on the protrusion.

13. A decorative light supporting assembly comprising:

a bonding element having multiple V-like bodies interlinked with one another;

a securing element having an opening defined through the securing element such that when the bonding element is deformed to combine the first rib and the second rib to form a stop, extension of the stop into the opening of the securing element is able to secure the deformation of the bonding element; and multiple support branches each having a frame with multiple fingers integrally formed in a periphery of the frame and an arrow-shaped connector integrally formed on a tip of each frame and being inclined relative to the frame such that insertion of the arrow-shaped connector from each support branch into the corresponding V-shaped body is able to secure engagement between the bonding element and the support branches.

14. The decorative light supporting assembly as claimed in claim 13, wherein each protrusion has a pair of cutouts defined in opposite side faces of the protrusion so that a clamp with a bulb securely attached thereto and arms extending in different directions is able to engage with bottom faces defining the cutouts to securely attach the bulb on the protrusion.

* * * * *